US012611032B2

(12) United States Patent
Zhu

(10) Patent No.: US 12,611,032 B2
(45) Date of Patent: Apr. 28, 2026

(54) ROCKING CHAIR

(71) Applicant: Zhejiang Sunshine Leisure Products Co., Ltd., Jinhua City (CN)

(72) Inventor: Xiaohui Zhu, Jinhua City (CN)

(73) Assignee: Zhejiang Sunshine Leisure Products Co., Ltd., Jinhua City (CN)

( * ) Notice: Subject to any disclaimer, the term of this patent is extended or adjusted under 35 U.S.C. 154(b) by 184 days.

(21) Appl. No.: 18/610,383

(22) Filed: Mar. 20, 2024

(65) Prior Publication Data

US 2024/0215728 A1 Jul. 4, 2024

(30) Foreign Application Priority Data

Nov. 22, 2023 (CN) ..... 202311573270.7
Nov. 22, 2023 (CN) ..... 202323161910.1
Dec. 1, 2023 (CN) ..... 202311639956.1

(51) Int. Cl.

| | |
|---|---|
| ***A47C 3/02*** | (2006.01) |
| ***A47C 3/021*** | (2006.01) |
| ***A47C 3/023*** | (2006.01) |
| ***A47C 3/025*** | (2006.01) |
| ***A47C 3/026*** | (2006.01) |
| ***A47C 4/03*** | (2006.01) |
| ***A47C 4/28*** | (2006.01) |

(Continued)

(52) U.S. Cl.

CPC ..... *A47C 3/023* (2013.01); *A47C 3/02* (2013.01); *A47C 3/021* (2013.01); *A47C 3/026* (2013.01); *A47C 4/03* (2013.01); *A47C 4/30* (2013.01); *A47C 7/44* (2013.01); *A47C 7/443* (2013.01)

(58) Field of Classification Search

CPC ..... A47C 4/286; A47C 1/03288; A47C 3/02; A47C 3/021; A47C 3/023; A47C 3/025; A47C 4/03; A47C 4/28; A47C 4/283; A47C 4/30; A47C 7/44; A47C 7/443

USPC ..... 297/314

See application file for complete search history.

(56) References Cited

U.S. PATENT DOCUMENTS 6,209,958 B1 * 4/2001 Thole ..... A47C 3/026 297/325
6,979,059 B1 * 12/2005 Conlin ..... A47C 7/448 297/314 X (Continued)

FOREIGN PATENT DOCUMENTS

CN 209915457 U 1/2020

*Primary Examiner* — Rodney B White
(74) *Attorney, Agent, or Firm* — Cooper Legal Group, LLC

(57) ABSTRACT

A rocking chair includes support bodies and a seat body. Support legs are mounted on the support bodies. A rocking frame assembly is mounted on the seat body. Two opposite parts of the seat body are defined as first and seconds matching surfaces. First and second blocking parts are formed on the first and second matching surfaces, respectively. The first and second blocking parts define offset rotation angle spaces on a path of relative rotation of the support bodies and the seat body. Elastic components are mounted in the offset rotation angle spaces, and the first and second blocking parts are driven by the relative rotation of the support bodies and the seat body to rotate oppositely along a rotation angle direction to squeeze the elastic components, thus causing the elastic components to generate an elastic force for the seat body to rock back and forth on the support bodies.

18 Claims, 10 Drawing Sheets

(51) Int. Cl.
*A47C 4/30* (2006.01)
*A47C 7/44* (2006.01)

(56) References Cited

U.S. PATENT DOCUMENTS

| | | | | |
|---|---|---|---|---|
| 8,141,944 | B2 * | 3/2012 | Reeb | A47C 9/105 297/45 X |
| 8,979,184 | B2 * | 3/2015 | Stafford | A47C 9/105 297/16.2 |
| 9,066,597 | B2 * | 6/2015 | Lee | A47C 4/42 |
| 9,339,115 | B2 * | 5/2016 | Lee | A47C 4/02 |
| 9,854,914 | B2 * | 1/2018 | Yoo | A47C 4/286 |
| 10,010,179 | B1 * | 7/2018 | Stump | A47C 4/44 |
| 10,149,545 | B2 * | 12/2018 | Bergling | A47D 9/005 |
| 10,548,399 | B2 * | 2/2020 | Humphreys | A47C 1/027 |
| 10,653,244 | B2 * | 5/2020 | Yang | A47C 3/025 |
| 11,439,238 | B1 * | 9/2022 | Wang | A47C 4/286 |
| 11,700,943 | B1 * | 7/2023 | Wang | A47C 4/286 297/16.2 |
| 11,737,564 | B2 * | 8/2023 | Chen | A47C 4/286 297/47 |
| 11,786,041 | B1 * | 10/2023 | Chen | A47C 4/42 297/16.1 |
| 11,844,439 | B1 * | 12/2023 | Wang | A47C 3/40 |
| 11,864,660 | B1 * | 1/2024 | Wang | F16M 11/242 |
| 11,871,848 | B1 * | 1/2024 | Wang | A47C 4/286 |
| 11,937,709 | B2 * | 3/2024 | Xu | A47B 3/12 |
| 11,969,102 | B2 * | 4/2024 | Sun | A47C 3/025 |
| 11,980,292 | B1 * | 5/2024 | Wang | A47C 7/14 |
| 11,980,296 | B2 * | 5/2024 | Kim | A47C 3/12 |
| 11,986,099 | B2 * | 5/2024 | Garcia | A47C 4/28 |
| 11,986,103 | B1 * | 5/2024 | Li | A47C 4/30 |
| 12,029,319 | B2 * | 7/2024 | Lin | A47C 3/0255 |
| 12,059,079 | B1 * | 8/2024 | Chen | A47C 4/286 |
| 12,075,919 | B2 * | 9/2024 | Fulbright | A47C 4/286 |
| 12,127,687 | B1 * | 10/2024 | Zhang | A47C 4/30 |
| 12,185,831 | B2 * | 1/2025 | Xu | A47B 13/02 |
| 12,185,843 | B2 * | 1/2025 | Yuan | A47C 4/286 |
| 12,349,806 | B1 * | 7/2025 | Wang | A47C 3/025 |
| 12,390,013 | B2 * | 8/2025 | Sun | A47C 3/0255 |
| 12,419,422 | B2 * | 9/2025 | Zhang | A47C 4/286 |
| 12,433,406 | B2 * | 10/2025 | Sun | A47C 4/021 |
| 2002/0117878 | A1 * | 8/2002 | Fox | A47C 4/286 297/16.2 |
| 2009/0174233 | A1 * | 7/2009 | Hoffman | A47C 4/286 297/16.2 |
| 2011/0156449 | A1 * | 6/2011 | Obolewicz | A47C 4/286 297/16.2 |
| 2011/0254325 | A1 * | 10/2011 | Obolewicz | A47C 4/286 297/16.2 |
| 2012/0306249 | A1 * | 12/2012 | Jung | A47C 3/026 297/313 |
| 2015/0189994 | A1 * | 7/2015 | Lee | A47C 4/30 297/16.1 |
| 2015/0233522 | A1 * | 8/2015 | Kallas | F16M 11/2021 403/322.2 |
| 2019/0231075 | A1 * | 8/2019 | Browning | A47C 4/286 |
| 2021/0317942 | A1 * | 10/2021 | Mendo | F16M 11/245 |
| 2023/0023969 | A1 * | 1/2023 | Zhu | A47C 4/286 |
| 2024/0016295 | A1 * | 1/2024 | Sun | A47C 4/021 |
| 2024/0415286 | A1 * | 12/2024 | Zhu | A47C 4/46 |
| 2025/0127304 | A1 * | 4/2025 | Tang | A47C 4/286 |

* cited by examiner

A-A

B–B

C–C

ROCKING CHAIR

CROSS-REFERENCE TO RELATED APPLICATIONS

This application claims priority to Chinese Patent Application 202311639956.1, filed on Dec. 1, 2023, Chinese Patent Application 202323161910.1, filed on Nov. 22, 2023, and Chinese Patent Application 202311573270.7, filed on Nov. 22, 2023. Chinese Patent Application 202311639956.1, Chinese Patent Application 202323161910.1, and Chinese Patent Application 202311573270.7 are incorporated herein by reference.

TECHNICAL FIELD

The present disclosure relates to the technical field of rocking chairs, and specifically to a rocking chair.

BACKGROUND

In the existing portable rocking chair disclosed in the Chinese patent No. CN209915457U, springs such as spiral springs or torsion springs are mounted between a leg support frame and a seat support frame to implement the restoration of rotation between the leg support frame and the seat support frame, and eventually reciprocating rocking of the rocking chair is implemented. This rocking solution has the following deficiencies:

1. The elastic coefficient of the springs is linear, such that when a user is overweight, it is likely to cause damage failure or great decline of rocking performance, thereby affecting the comfort of the user during use and being incapable of meeting the requirements of a wide range of user groups.

2. The springs are prone to mechanical fatigue, such that the rocking reliability of the rocking chair will be greatly reduced after long-time use.

3. The springs are metal components, which easily produce noise during extension and contraction movement, thereby affecting usage experience of the user.

4. The spiral springs are mounted in an exposed manner and not easy to use, and have a wide rocking regulation control range, such that the regulation control error is great, the precise rocking regulation is difficult to implement, the rocking process of a rocking part is more prone to rocking in a front-back direction and has a small range of rocking in an up-down direction, and the user has low comfort. The torsion springs make the rocking operation laborious, and make it difficult to control a rocking path and a stroke range of the rocking part, resulting in insufficient stability and reliability.

SUMMARY

An objective of the present disclosure is to provide a rocking chair, to solve the above technical problems.

To achieve the above objective, the present disclosure adopts the following technical solution: there is provided a rocking chair, including support bodies and a seat body arranged in a relative rotation manner, where support legs are mounted on the support bodies; a rocking frame assembly for a human body to recline on is mounted on the seat body; two opposite parts of the seat body that match with the support bodies in a relative rotation manner are defined as a first matching surface and a second matching surface, respectively; first blocking parts are formed on the first matching surface; second blocking parts are formed on the second matching surface; the first blocking parts and the second blocking parts define offset rotation angle spaces on a path of relative rotation of the support bodies and the seat body; elastic components with a non-constant elastic coefficient are mounted in the offset rotation angle spaces; and the first blocking parts and the second blocking parts are driven by the relative rotation of the support bodies and the seat body to rotate oppositely along a rotation angle direction to squeeze the elastic components, thus causing the elastic components to generate an elastic force for the seat body to rock back and forth on the support bodies.

Preferably, the elastic components are polyurethane (PU) elastic blocks, thermoplastic polyurethane (TPU) elastic blocks, or rubber blocks.

Preferably, there are two offset rotation angle spaces in centrosymmetric distribution; and the elastic components are mounted in the offset rotation angle spaces in a one-to-one correspondence manner.

Preferably, a plurality of through holes are provided inside each of the elastic components.

Preferably, each of the support bodies includes two support ends, and a central connecting shaft and side connecting shafts fixedly connected between the two support ends; a central channel and rotation limit channels are arranged in the seat body; the central connecting shaft is arranged in the central channel in a penetration manner; the side connecting shafts are arranged in the rotation limit channels in a penetration manner, such that the seat body is arranged between the two support ends in a manner of rotating about the central connecting shaft; and the rotation limit channels are configured to limit a rotation angle of the seat body.

The present disclosure has the following beneficial effects:

(1) The elastic coefficient of the elastic components in the present disclosure is non-constant, such that users with high weight can all have a good rocking experience during use, and it is unlikely to cause damage failure or great decline of rocking performance, thereby ensuring the comfort of the users during use and meeting the requirements of a wide range of user groups.

(2) The elastic components are the PU elastic blocks made from PU, which are not prone to mechanical fatigue and ensure that the rocking reliability of the rocking chair will not be affected after long-time use.

(3) The elastic components are flexible non-metallic components, which do not produce noise during extension and contraction movement, thereby ensuring usage experience of the users.

(4) The structural design is reasonable and clever, in which the rocking regulation control is integrated between the seat body and the support bodies, and has a small range, thereby reducing the regulation control error and meeting the requirements of precise rocking regulation. Moreover, the rocking operation is easier and more labor-saving, and the rocking process is more prone to rocking in an up-down direction and has a small range of rocking in a front-back direction, thereby improving the comfort of the users, facilitating quick sleep of the users and limitation to a rocking path and a stroke range of a rocking part, ensuring the stability and reliability of the rocking process, and extending the overall service life.

Figure 1:
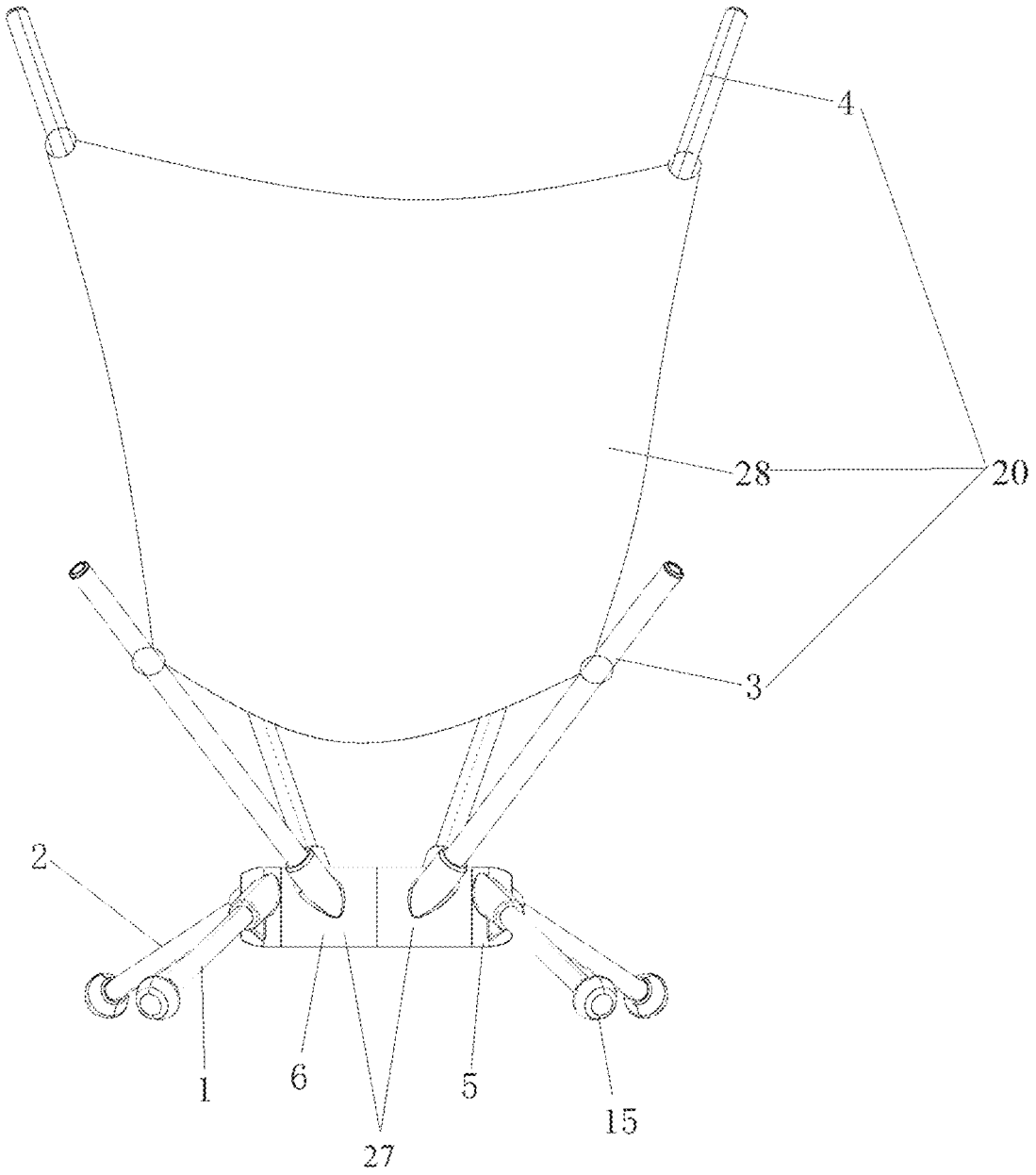
FIG. 1 is a front view of an embodiment of the present disclosure.

In the drawings: 1. front support leg tube; 2. rear support leg tube; 3. support leg tube; 4. backrest tube; 5. support body; 51. reinforcing block; 52. central shaft hole; 53. side shaft hole; 6. seat body; 61. central channel; 62. accommodating groove; 63. rotation limit channel; 631. arc-shaped channel opening; 64. limit step; 65. blind hole; 7. elastic component; 71. through hole; 8. central connecting shaft; 9. side connecting shaft; 10. bearing; 11. limit sleeve; 12. central bolt; 13. side bolt; 14. fixed connecting shaft; 15. rubber leg cover; 20. rocking frame assembly; 21. first matching surface; 22. second matching surface; 23. first blocking part; 24. second blocking part; 25. offset rotation angle space; 26. support end; 27. sub-seat body; and 28. support recliner cushion.

DESCRIPTION OF EMBODIMENTS

To further describe embodiments, the present disclosure provides accompanying drawings. These drawings constitute a part of content of the present disclosure and are mainly used to illustrate the embodiments and to explain the operating principles of the embodiments in conjunction with the related description of the specification. With reference to the content, those of ordinary skill in the art can understand other possible embodiments and advantages of the present disclosure. Components in figures are not drawn to scale, and similar component signs are often used to refer to similar components.

In the description of the present disclosure, "a plurality of" means two or more, unless otherwise noted; and the orientations or positional relationships indicated by the terms "up", "down", "left", "right", "inside", "outside", "front end", "rear end", "head", "tail", etc. are the orientations or positional relationships shown in the accompanying drawings, merely for the convenience of describing the present disclosure and simplifying the description, rather than indicating or implying that the referred apparatus or element must have a particular orientation or be constructed and operated in a particular orientation, and therefore should not be understood as limiting the present disclosure. In addition, the terms "first", "second", "third", and the like are used for descriptive purposes only and are not to be construed as indicating or implying relative importance.

Figure 2:
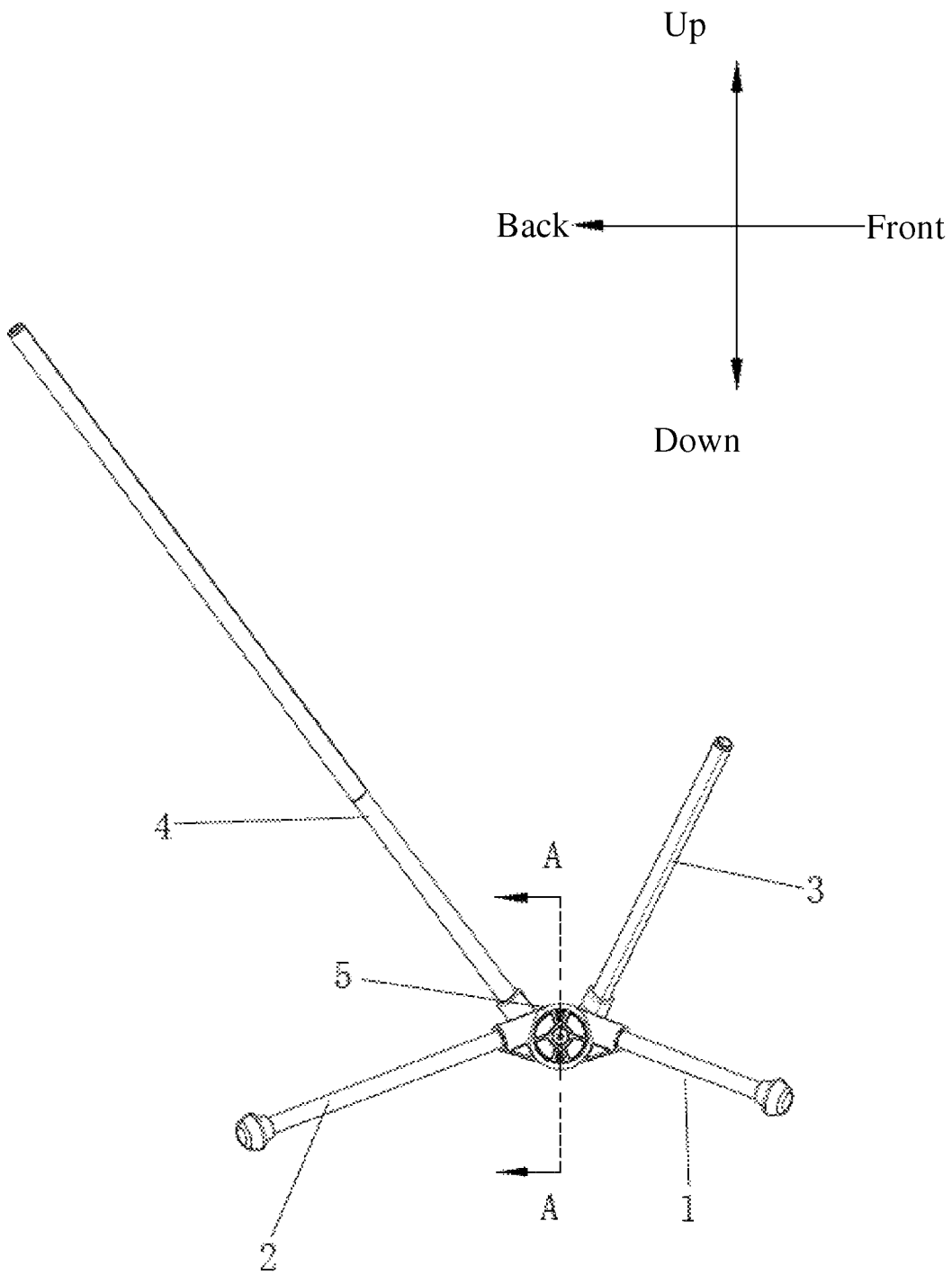
FIG. 2 is a right view of an embodiment of the present disclosure.
Figure 3:
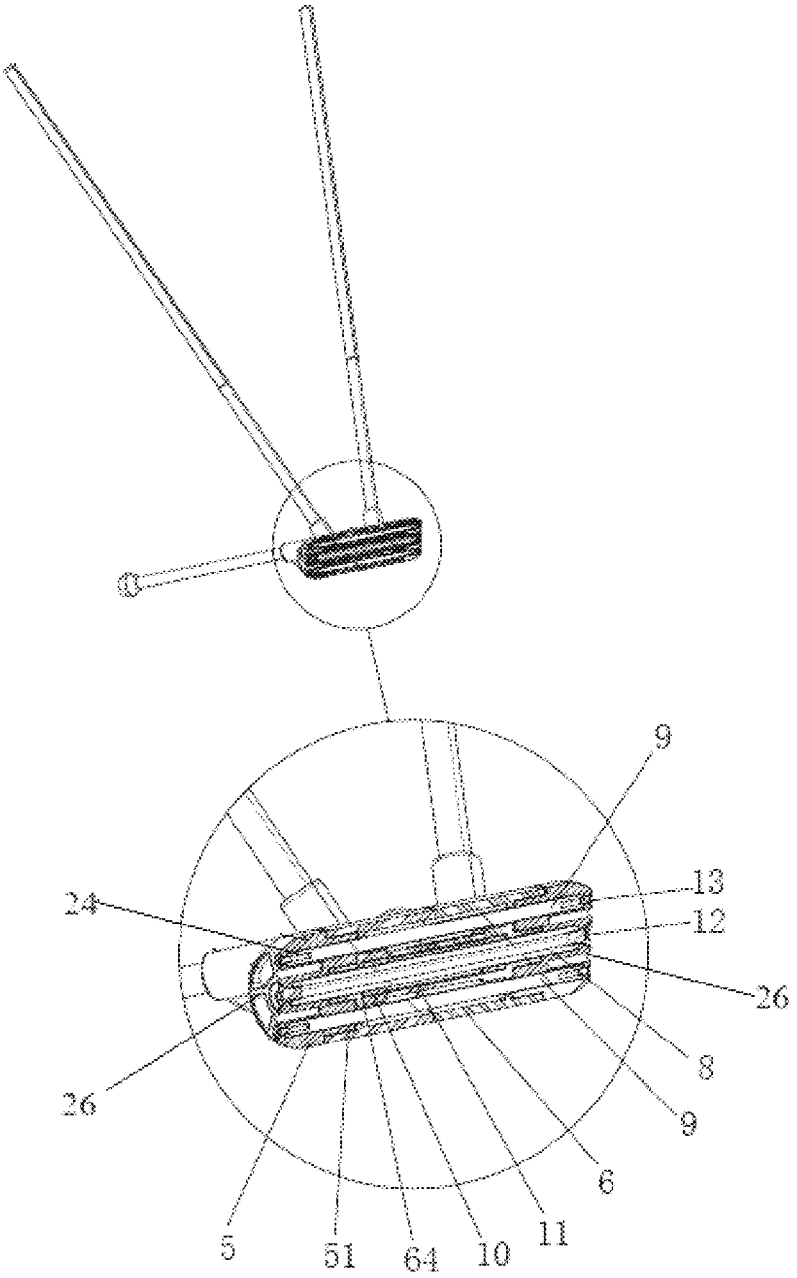
FIG. 3 is a sectional view of A-A in FIG. 2.
Figure 4:
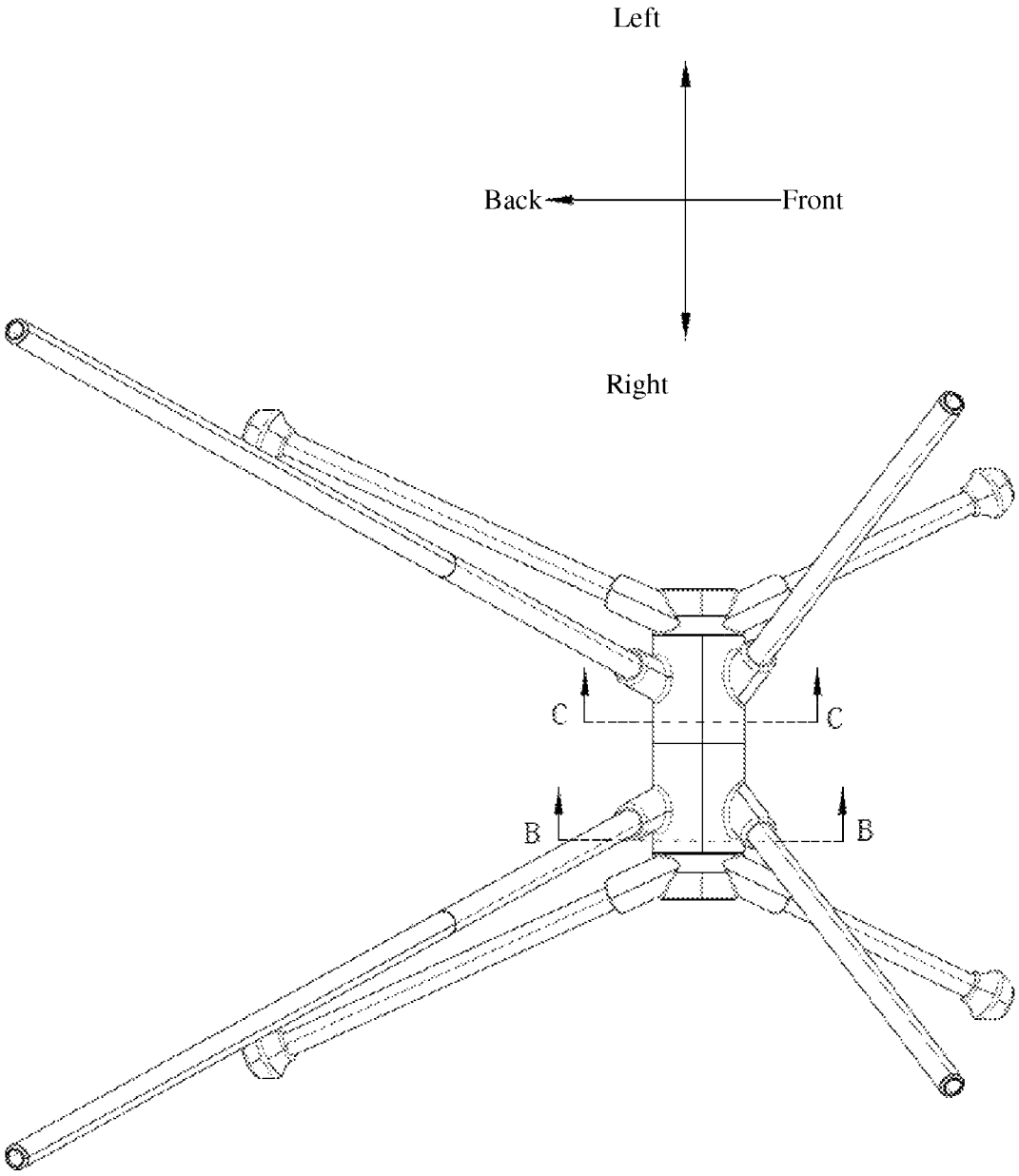
FIG. 4 is a top view of an embodiment of the present disclosure.
Figure 5:
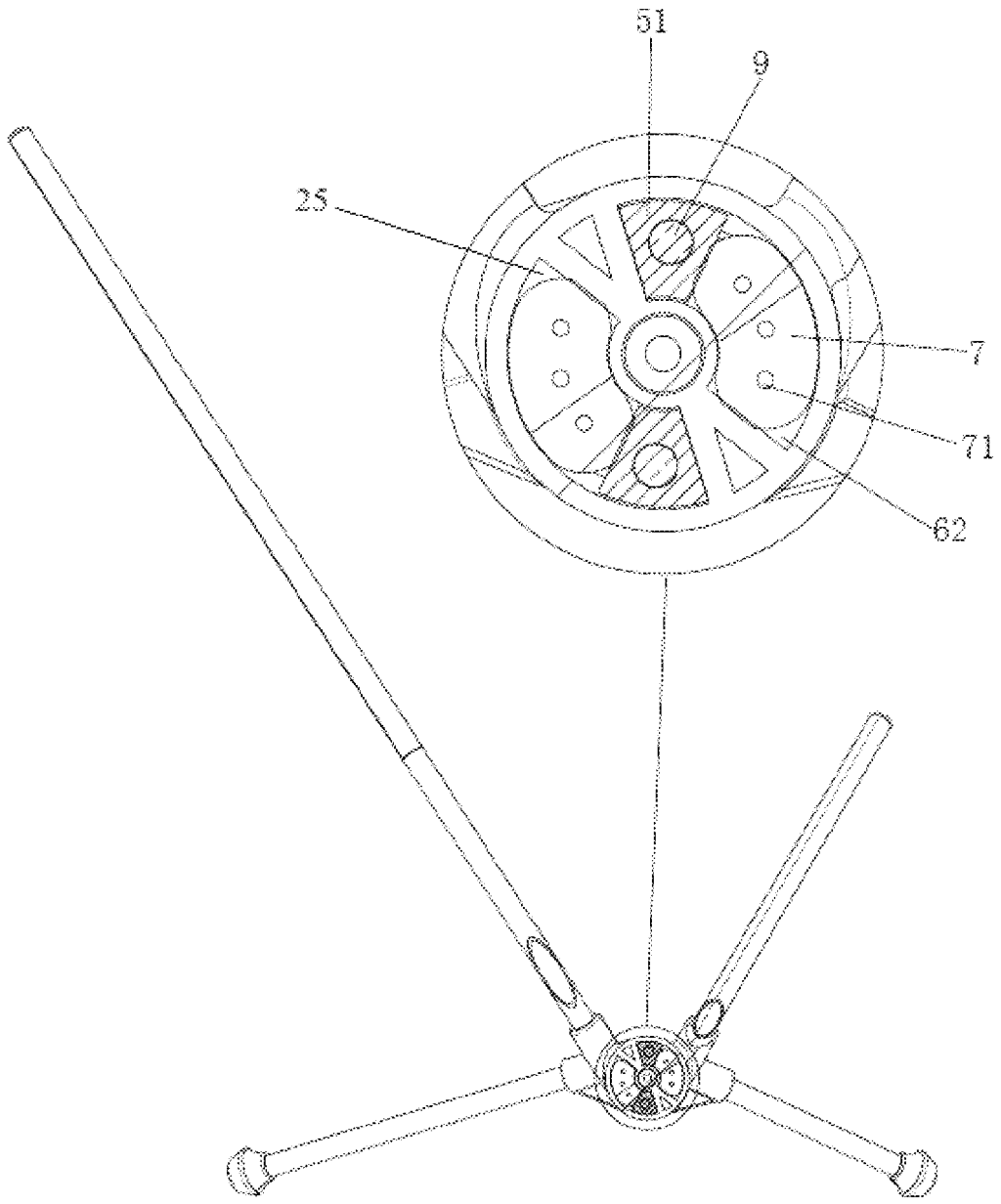
FIG. 5 is a sectional view of B-B in FIG. 4.
Figure 6:
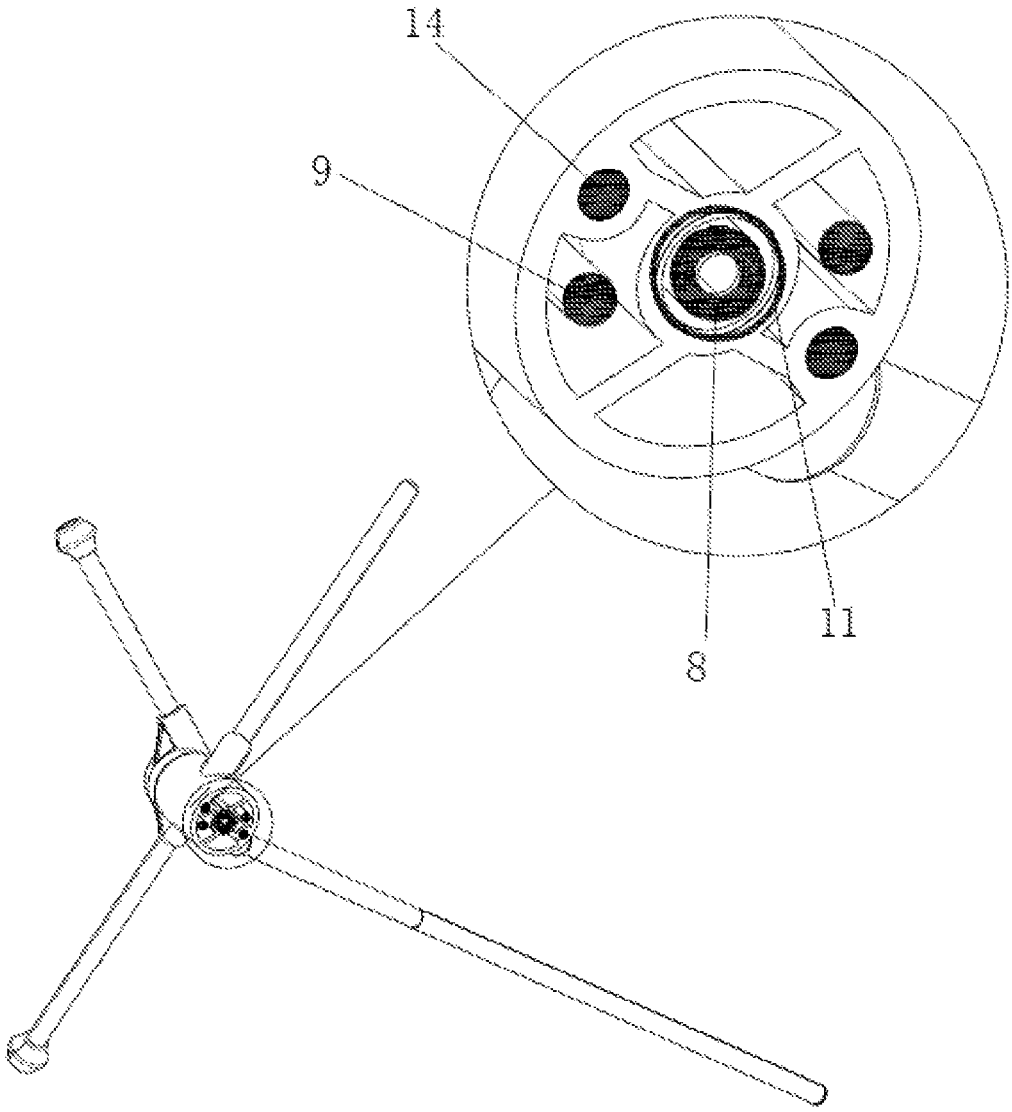
FIG. 6 is a sectional view of C-C in FIG. 4.
Figure 7:
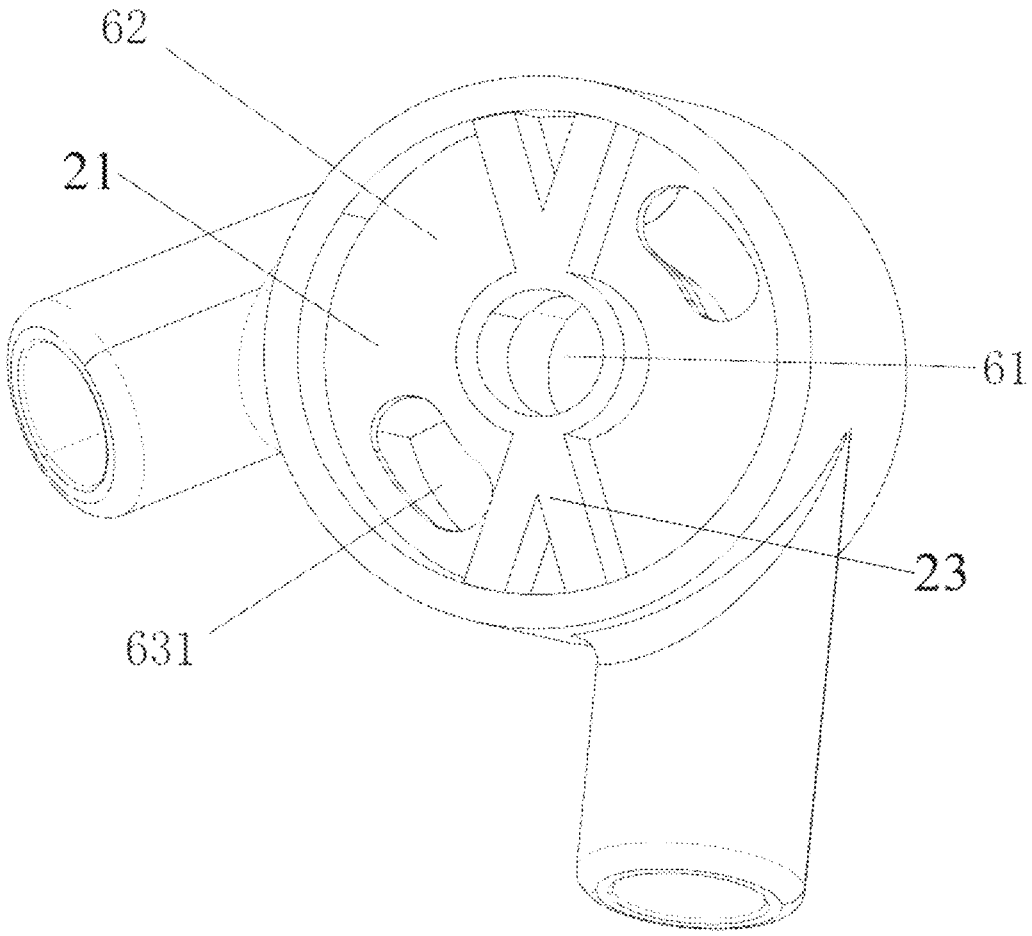
FIG. 7 is an outer side view of a seat body in an embodiment of the present disclosure.
Figure 8:
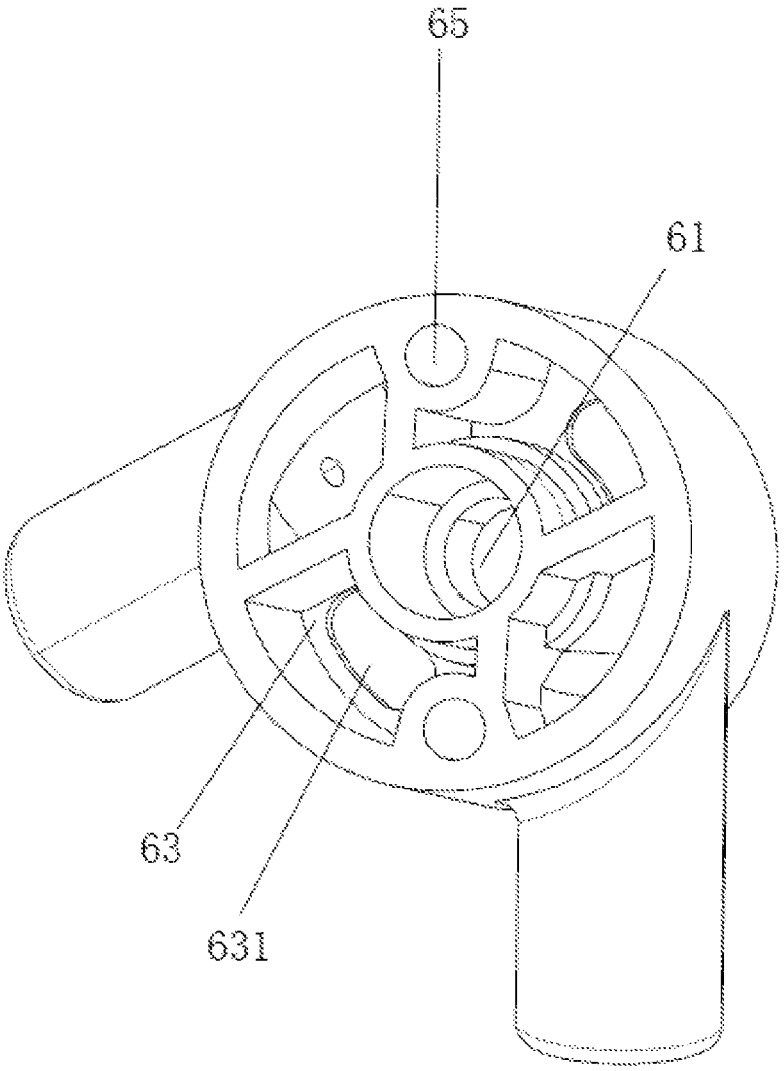
FIG. 8 is an inner side view of a seat body in an embodiment of the present disclosure.
Figure 9:
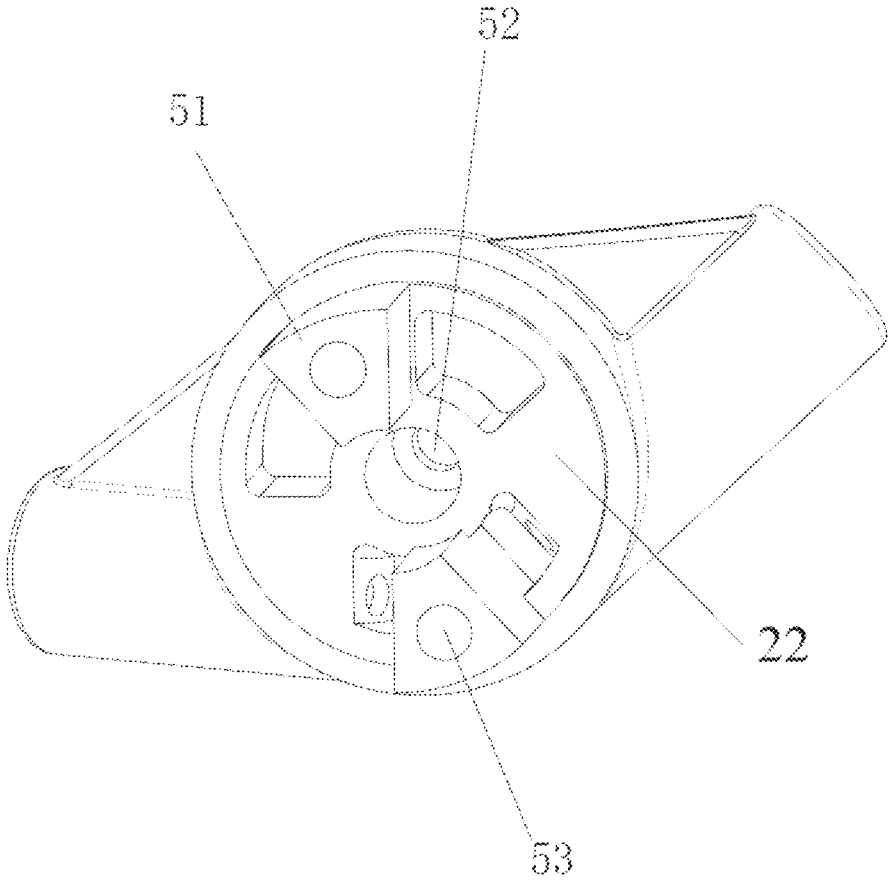
FIG. 9 is an inner side view of a support body in an embodiment of the present disclosure.
Figure 10:
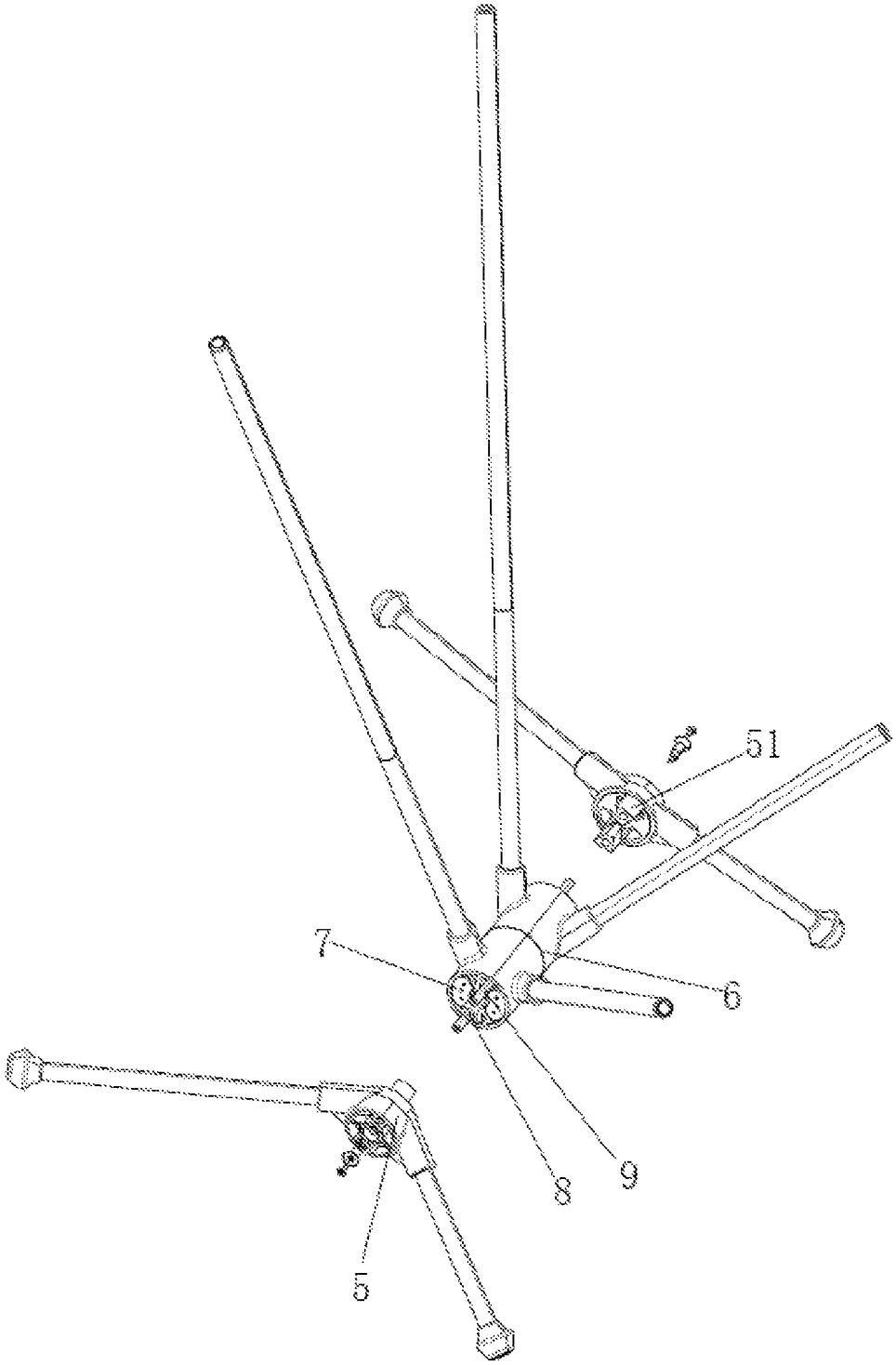
FIG. 10 is a schematic exploded view of an embodiment of the present disclosure.

Referring to FIGS. 1 to 10, as an embodiment of the present disclosure, there is provided a rocking chair, including support bodies 5 and a seat body 6 arranged in a relative rotation manner, where support legs are mounted on the support bodies 5; a rocking frame assembly 20 for a human body to recline on is mounted on the seat body 6; the seat body 6 and the rocking frame assembly 20 constitute a rocking part; in this embodiment, directions up, down, front, and back are as shown by arrow directions in FIG. 2 and FIG. 4; two opposite parts of the seat body 6 that match with the support bodies 5 in a relative rotation manner are defined as a first matching surface 21 and a second matching surface 22, respectively; first blocking parts 23 are formed on the first matching surface 21; second blocking parts 24 are formed on the second matching surface 22; the first blocking parts 23 and the second blocking parts 24 define offset rotation angle spaces 25 on a path of relative rotation of the support bodies 5 and the seat body 6; elastic components 7 with a non-constant elastic coefficient are mounted in the offset rotation angle spaces 25 and are specifically PU elastic blocks, the non-constant elastic coefficient refers to that a relationship between an elastic force and a compression amount is a non-linear relationship, and a function curve thereof is specifically a parabola with an upward opening; and the first blocking parts 23 and the second blocking parts 24 are driven by the relative rotation of the support bodies 5 and the seat body 6 to rotate oppositely along a rotation angle direction to squeeze the elastic components 7, thus causing the elastic components 7 to generate the elastic force for the seat body 6 to rock back and forth on the support bodies 5.

Each of the support bodies 5 includes two support ends 26, and a central connecting shaft 8 and side connecting shafts 9 fixedly connected between the two support ends 26, where a central channel 61 and rotation limit channels 63 are arranged in the seat body 6; the central connecting shaft 8 is arranged in the central channel 61 in a penetration manner; the side connecting shafts 9 are arranged in the rotation limit channels 63 in a penetration manner, such that the seat body 6 is arranged between the two support ends 26 in a manner of rotating about the central connecting shaft 8; and the rotation limit channels 63 are configured to limit a rotation angle of the seat body 6. Specifically, central shaft holes 52 are provided in centers of the two support ends 26; and two ends of the central connecting shaft 8 penetrate out of the central shaft holes 52 of the two support ends 26 and are locked and fixed to a central bolt 12.

In this embodiment, the first matching surface 21 is located on the seat body 6; the second matching surface 22 is located on the support bodies 5; the first matching surface 21 of the seat body 6 is provided with accommodating grooves 62; channel openings of the rotation limit channels 63 are located on surfaces of the accommodating grooves 62 so that the side connecting shafts 9 penetrate out of the accommodating grooves 62; the elastic components 7 are mounted in the accommodating grooves 62; regions of the accommodating grooves 62 that correspondingly match with the elastic components 7 form the first blocking parts 23; regions of the side connecting shafts 9 that correspondingly match with the elastic components 7 form the second blocking parts 24; and the first blocking parts 23 and the elastic components 7 together rotate oppositely along the rotation angle direction relative to the second blocking parts 24, such that the elastic components 7 are squeezed by the second blocking parts 24, thus causing the elastic components 7 to generate the elastic force for the seat body 6 to rock back and forth on the support bodies 5.

A process of using the present disclosure is as follows: one end of the rotation limit channel 63 that gets away from the elastic component 7 is defined as an initial end, and one end of the rotation limit channel 63 that gets close to the elastic component 7 is defined as a final end. In an initial state, the side connecting shafts 9 are located at the initial ends of the rotation limit channels 63, and a user reclines on a support recliner cushion 28 and applies a force downwards with his back to drive the rocking part to rotate downwards (in a counterclockwise direction of a viewing angle in FIG. 5). During this process, the elastic components 7 rotate downwards along with the seat body 6; the elastic components 7 gradually rotate and squeeze the side connecting shafts 9 for elastic energy storage and have a maximum elastic force until the side connecting shafts 9 are located at the final ends of the rotation limit channels 63; then, under the elastic force of the elastic components 7, the seat body 6 rotate upwards to be restored (in a clockwise direction of the viewing angle in FIG. 5), such that the rocking part rotates upward to be restored; and the above actions are repeated to implement the up-down rocking process of the rocking part. According to the present disclosure, the seat body 6 is arranged on the support bodies 5 in a rockable manner through the cooperation among the elastic components 7 with the non-constant elastic coefficient, the first blocking parts 23, and the second blocking parts 24. The structure of the present disclosure has the following advantages:

1. In an existing technical solution of using springs, the elasticity coefficient of the springs is constant, such that the weight of the user can only be supported stably within a certain compression amount in a wide-range movement system. For example, a user weighing 40 kg will feel comfortable, but a user weighing 70 kg or more will feel very soft when using the rocking chair, and the comfort is greatly reduced, which is determined by the characteristics of the springs with a great change. In the solution of the present application, the elastic coefficient of the elastic components 7 is non-constant, and a function relationship between the elastic force and the compression amount is specifically a curve opening upwards and similar to a parabola. Under the condition of a same compression amount difference, the more the compression is carried out backwards, the larger an elastic force difference is, such that the compression deformation amount of the PU elastic blocks will not be too large for the user with high weight during use, and the users weighing both 40 kg and 70 kg can have a good rocking experience during use. When the user is overweight, it is unlikely to cause damage failure or great decline of rocking performance even if the weight exceeds 70 kg, thereby ensuring the comfort of the user during use and meeting the requirements of a wide range of user groups.

2. The elastic components 7 are the PU elastic blocks made from PU, which are not prone to mechanical fatigue and ensure that the rocking reliability of the rocking chair will not be affected after long-time use.

3. The elastic components 7 are flexible non-metallic components, which do not produce noise during extension and contraction movement, thereby ensuring usage experience of the users.

4. The structural design is reasonable and clever, in which the rocking regulation control is integrated between the seat body 6 and the support bodies 5, and has a small range, thereby reducing the regulation control error and meeting the requirements of precise rocking regulation. Moreover, the rocking operation is easier and more labor-saving, and the rocking process is more prone to rocking in an up-down direction and has a small range of rocking in a front-back direction, thereby improving the comfort of the users, facilitating quick sleep of the users and limitation to a rocking path and a stroke range of the rocking part, ensuring the stability and reliability of the rocking process, and extending the overall service life.

Certainly, in other cases, the central connecting shaft 8 and the side connecting shafts 9 may not be provided. For example, the seat body 6 and the support bodies 5 can rotate coaxially relative to each other through the connection of a bearing mechanism. In addition, assembly positions of the seat body 6 and the support bodies 5 may also be exchanged, that is, there may be two seat bodies 6 fixedly connected to each other and one support body 5. The two seat bodies 6 are arranged at two ends of the support body 5 in a simultaneously rotatable manner, as long as the seat bodies 6 and the support body 5 can rotate relative to each other.

In this embodiment, there are two offset rotation angle spaces 25 in centrosymmetric distribution; and the elastic components 7 are mounted in the offset rotation angle spaces 25 in a one-to-one correspondence manner, such that the stress is more balanced and stable. Correspondingly, there are two accommodating grooves 62 in the first matching surface 21 of the seat body 6, and the two accommodating grooves 62 are arranged on a front side and a rear side of the central channel 61 in a centrosymmetric manner. An arc-shaped channel opening 631 in the accommodating groove 62 on the front side is located at a top end of the seat body 6, and an arc-shaped channel opening 631 in the accommodating groove 62 on the rear side is located at a bottom end of the seat body 6. This arrangement makes the rocking process of the rocking part more prone to rocking in the up-down direction, reduces the range of rocking in the front-back direction, and further improves the rocking comfort.

In this embodiment, the accommodating grooves 62 are fan-shaped, and the elastic components 7 are arc-shaped PU elastic blocks with a better elastic effect. The shape setting of the accommodating grooves 62 and the elastic components 7 implements a higher degree of matching therebetween and smoother movement. Three through holes 71 are provided inside the PU elastic block and are uniformly arranged in an arc shape in the elastic component 7, that is, a center of an arc line formed by the three through holes 71 is located on a central axis of the central connecting shaft 8. This arrangement ensures that the rocking process of the rocking chair is in a most comfortable state. Certainly, in other cases, the number of through holes 71 may be different and is not limited herein. The elastic components 7 may also be thermoplastic polyurethane (TPU) elastic blocks or rubber blocks.

In this embodiment, reinforcing blocks 51 are formed on peripheries of the support ends 26 that correspond to the second blocking parts 24; the reinforcing blocks 51 and the elastic components 7 are mounted in the accommodating grooves 62 in a clearance fit manner; the first blocking parts 23 and the elastic components 7 together rotate oppositely along the rotation angle direction relative to the reinforcing blocks 51, such that the elastic components 7 are squeezed by the reinforcing blocks 51, thus causing the elastic components 7 to generate the elastic force for the seat body 6 to rock back and forth on the support bodies 5. In other words, side shaft holes 53 are arranged in the support ends 26 that correspond to the reinforcing blocks 51, two ends of the side connecting shaft 9 penetrate out of the side shaft holes 53 in the two support ends 26 and are locked and fixed to side bolts 13, and the reinforcing blocks 51 are correspondingly arranged in the accommodating grooves 62 and rotate relative to the elastic components 7 to implement elastic squeezing fit, such that the side connecting shafts 9 are prevented from directly contacting with and squeezing the elastic components 7 and are better protected. Moreover, compared with a mode that the side connecting shafts 9 directly contact with and squeeze the elastic components 7, this technical solution improves the strength and stability in the rocking process, and the reinforcing blocks 51 are fan-shaped, such that the reinforcing blocks can be tightly mounted in the accommodating grooves 62, and the elastic squeezing fit between the reinforcing blocks and the elastic components 7 is smoother.

In this embodiment, the elastic components 7 are squeezed by the reinforcing blocks 51 during assembly to form a certain preloaded pressure, that is, the elastic components 7 have a certain compression amount to form a certain elastic driving force.

In this embodiment, the channel openings at two ends of the rotation limit channel 63 are arc-shaped channel openings 631 corresponding to the rotation angle direction, and the arc center of the arc-shaped channel opening 631 is located on the central axis of the central connecting shaft 8, so as to ensure that the seat body 6 can rotate about the central axis, and the rotation process is more accurate and stable. Correspondingly, the remaining part of the rotation limit channel 63 except for the arc-shaped channel openings 631 may be made into a large-area hollow structure, so as to reduce the weight of the seat body 6. Certainly, a shape and a size of a cross section of the rotation limit channel 63 may be set to be consistent with those of the arc-shaped channel opening 631, but the overall weight of the seat body 6 is large.

In this embodiment, the seat body 6 includes two sub-seat bodies 27 assembled in a mirror symmetry manner, two bearings 10 sleeved outside the central connecting shaft 8, and a limit sleeve 11, where the bearings 10 are needle roller bearings; the limit sleeve 11 is located between the two bearings 10; limit steps 64 are formed at outer ends of the sub-seat bodies 27 that correspond to the central channel 61; and the bearings 10 are pressed into the central channel 61 between the limit sleeve 11 and the limit steps 64. This arrangement can reduce a force of friction between the central connecting shaft 8 and the central channel 61, thereby improving the smoothness of rotation of the seat body 6 between the two support bodies 5.

In this embodiment, the rocking chair further includes fixed connecting shafts 14, where blind holes 65 are provided in opposite end surfaces of the two sub-seat bodies 27; and two ends of each of the fixed connecting shafts 14 are fixedly inserted into the blind holes 65 of the two sub-seat bodies 27 so that the two sub-seat bodies 27 are fixedly assembled to form the complete seat body 6. The arrangement of the two sub-seat bodies 27 can facilitate the mounting of the bearings 10) and the limit sleeve 11.

In this embodiment, the rocking frame assembly 20 includes support leg tubes 3, backrest tubes 4, and a support recliner cushion 28, where the support leg tubes 3 are mounted on a front side of the seat body 6, the backrest tubes 4 are mounted on a rear side of the seat body 6, the support recliner cushion 28 is mounted between the support leg tubes 3 and the backrest tubes 4 along a front-back direction, a length of the backrest tube 4 is greater than twice a length of the support leg tube 3, the backrest tube 4 includes a long backrest tube and a short backrest tube arranged coaxially, and the long backrest tube is mounted at one end of the short backrest tube that gets away from the seat body 6, such that the arranged support recliner cushion 28 is convenient for the human body to lie down in the front-back direction, and thus the operation of rocking in the front-back and up-down directions is carried out; or in other cases, the support leg tubes 3 are mounted on a left side of the seat body 6, the backrest tubes 4 are mounted on a right side of the seat body 6, and the support recliner cushion 28 is mounted between the support leg tubes 3 and the backrest tubes 4 along a left-right direction (that is, the backrest tubes 4 and the support leg tubes 3 are located on positions of the seat body 6 that get close to the support bodies 5 on two sides, respectively), such that the arranged support recliner cushion 28 is convenient for the human body to lie down in the left-right direction, and thus the operation of rocking in the left-right and up-down directions is carried out; in addition, the support leg tubes 3 are mounted on the right side of the seat body 6, the backrest tubes 4 are mounted on the left side of the seat body 6, and the positions of the support leg tubes and the backrest tubes may be mutually exchanged, that is, the layout and structural shape of the support legs and the rocking frame assembly 20 may be regulated according to actual requirements and are not limited herein.

In this embodiment, the support legs include front support leg tubes 1 and rear support leg tubes 2 mounted on front sides and rear sides of the support bodies 5, respectively, where a length of the rear support leg tube 2 is greater than a length of the front support leg tube 1, a rubber leg cover 15 is mounted at a bottom of the front support leg tube 1 or the rear support leg tube 2, and a bottom of the rubber leg cover 15 is in a circular truncated cone shape with a wide upper part and a narrow lower part, thereby ensuring the overall support stability. Certainly, the support legs may also be of an inverted T-shaped structure to be fixedly mounted on bottom sides of the support bodies 5.

In this embodiment, the seat body 6 is cylindrical, the support ends 26 are cylindrical ends corresponding to the seat body 6 in shape, and the matching surfaces of the seat body 6 that match with the support bodies 5 have the same area, thereby ensuring that the overall assembly is more attractive. Correspondingly, the support ends 26 and the seat body 6 are formed with insertion holes for mounting the support legs and the rocking frame assembly 20.

In this embodiment, there are two rear support leg tubes 2, two front support leg tubes 1, two backrest tubes 4, and two support leg tubes 3, where the rear support leg tubes 2 and the front support leg tubes 1 extend towards four corners at a bottom of the rocking chair, the backrest tubes 4 and the support leg tubes 3 extend towards four corners at a top of the rocking chair, and an angle between the backrest tube 4 and the support leg tube 3 is smaller than an angle between the rear support leg tube 2 and the front support leg tube 1, thereby ensuring stable support and comfort of leaning. In addition, the structure of the front support leg tube 1, the rear support leg tube 2, the support leg tube 3, and the backrest tube 4 is not limited to a tubular structure and may also be a rod-shaped structure.

While the present disclosure has been specifically shown and described with reference to the preferred embodiments, it is to be understood by those skilled in the art that various changes in form and details may be made to the present disclosure without departing from the spirit and scope of the present disclosure defined by the appended claims, and all fall within the scope of protection of the present disclosure.

The invention claimed is:

1. A rocking chair, comprising support bodies and a seat body arranged in a relative rotational manner, wherein support legs are mounted on the support bodies; a rocking frame assembly for a human body to recline on is mounted on the seat body; two opposite parts of the seat body that match with the support bodies in a relative rotational manner are defined as a first matching surface and a second matching surface, respectively; first blocking parts are formed on the first matching surface; second blocking parts are formed on the second matching surface; the first blocking parts and the second blocking parts define offset rotation angle spaces on a path of relative rotation of the support bodies and the seat body; elastic components with a non-constant elastic coefficient are mounted in the offset rotation angle spaces; and the first blocking parts and the second blocking parts are driven by the relative rotation of the support bodies and the seat body to rotate oppositely along a rotation angle direction to squeeze the elastic components, thus causing the elastic components to generate an elastic force for the seat body to rock back and forth on the support bodies.

2. The rocking chair according to claim 1, wherein the elastic components are polyurethane (PU) elastic blocks, thermoplastic polyurethane (TPU) elastic blocks, or rubber blocks.

3. The rocking chair according to claim 2, wherein the rocking frame assembly comprises support leg tubes, backrest tubes, and a support recliner cushion; and at least one of:

the support leg tubes are mounted on a front side of the seat body, the backrest tubes are mounted on a rear side of the seat body, and the support recliner cushion is mounted between the support leg tubes and the backrest tubes along a front-back direction;

the support leg tubes are mounted on a left side of the seat body, the backrest tubes are mounted on a right side of the seat body, and the support recliner cushion is mounted between the support leg tubes and the backrest tubes along a left-right direction; or the support legs comprise front support leg tubes and rear support leg tubes mounted on front sides and rear sides of the support bodies, respectively.

4. The rocking chair according to claim 1, wherein there are two of the offset rotation angle spaces in centrosymmetric distribution; and the elastic components are mounted in the offset rotation angle spaces in a one-to-one correspondence manner.

5. The rocking chair according to claim 4, wherein the rocking frame assembly comprises support leg tubes, backrest tubes, and a support recliner cushion; and at least one of:

the support leg tubes are mounted on a front side of the seat body, the backrest tubes are mounted on a rear side of the seat body, and the support recliner cushion is mounted between the support leg tubes and the backrest tubes along a front-back direction;

the support leg tubes are mounted on a left side of the seat body, the backrest tubes are mounted on a right side of the seat body, and the support recliner cushion is mounted between the support leg tubes and the backrest tubes along a left-right direction; or the support legs comprise front support leg tubes and rear support leg tubes mounted on front sides and rear sides of the support bodies, respectively.

6. The rocking chair according to claim 1, wherein a plurality of through holes are provided inside each of the elastic components.

7. The rocking chair according to claim 6, wherein the rocking frame assembly comprises support leg tubes, backrest tubes, and a support recliner cushion; and at least one of:

the support leg tubes are mounted on a front side of the seat body, the backrest tubes are mounted on a rear side of the seat body, and the support recliner cushion is mounted between the support leg tubes and the backrest tubes along a front-back direction;

the support leg tubes are mounted on a left side of the seat body, the backrest tubes are mounted on a right side of the seat body, and the support recliner cushion is mounted between the support leg tubes and the backrest tubes along a left-right direction; or the support legs comprise front support leg tubes and rear support leg tubes mounted on front sides and rear sides of the support bodies, respectively.

8. The rocking chair according to claim 1, wherein each of the support bodies comprises two support ends, and a central connecting shaft and side connecting shafts fixedly connected between the two support ends; a central channel and rotation limit channels are arranged in the seat body; the central connecting shaft is arranged in the central channel in a penetrating manner; the side connecting shafts are arranged in the rotation limit channels in a penetrating manner, such that the seat body is arranged between the two support ends in a manner of rotating about the central connecting shaft; and the rotation limit channels are configured to limit a rotation angle of the seat body.

9. The rocking chair according to claim 8, wherein the rocking frame assembly comprises support leg tubes, backrest tubes, and a support recliner cushion; and at least one of:

the support leg tubes are mounted on a front side of the seat body, the backrest tubes are mounted on a rear side of the seat body, and the support recliner cushion is mounted between the support leg tubes and the backrest tubes along a front-back direction;

the support leg tubes are mounted on a left side of the seat body, the backrest tubes are mounted on a right side of the seat body, and the support recliner cushion is mounted between the support leg tubes and the backrest tubes along a left-right direction; or the support legs comprise front support leg tubes and rear support leg tubes mounted on front sides and rear sides of the support bodies, respectively.

10. The rocking chair according to claim 8, wherein the first matching surface is located on the seat body; the second matching surface is located on the support bodies; the first matching surface of the seat body is provided with accommodating grooves; channel openings of the rotation limit channels are located on surfaces of the accommodating grooves so that the side connecting shafts penetrate out of the accommodating grooves; the elastic components are mounted in the accommodating grooves: regions of the accommodating grooves that correspondingly match with the elastic components form the first blocking parts; regions of the side connecting shafts that correspondingly match with the elastic components form the second blocking parts; and the first blocking parts and the elastic components together rotate oppositely along the rotation angle direction relative to the second blocking parts, such that the elastic components are squeezed by the second blocking parts, thus causing the elastic components to generate the elastic force for the seat body to rock back and forth on the support bodies.

11. The rocking chair according to claim 10, wherein the rocking frame assembly comprises support leg tubes, backrest tubes, and a support recliner cushion; and at least one of:

the support leg tubes are mounted on a front side of the seat body, the backrest tubes are mounted on a rear side of the seat body, and the support recliner cushion is mounted between the support leg tubes and the backrest tubes along a front-back direction;

the support leg tubes are mounted on a left side of the seat body, the backrest tubes are mounted on a right side of the seat body, and the support recliner cushion is mounted between the support leg tubes and the backrest tubes along a left-right direction; or the support legs comprise front support leg tubes and rear support leg tubes mounted on front sides and rear sides of the support bodies, respectively.

12. The rocking chair according to claim 10, wherein at least one of:

reinforcing blocks are formed on peripheries of the support ends that correspond to the second blocking parts; the reinforcing blocks and the elastic components are mounted in the accommodating grooves in a clearance fit manner; the first blocking parts and the elastic components together rotate oppositely along the rotation angle direction relative to the reinforcing blocks, such that the elastic components are squeezed by the reinforcing blocks, thus causing the elastic components to generate the elastic force for the seat body to rock back and forth on the support bodies; or the channel openings of the rotation limit channels are arc-shaped channel openings corresponding to the rotation angle direction.

13. The rocking chair according to claim 12, wherein the rocking frame assembly comprises support leg tubes, backrest tubes, and a support recliner cushion; and at least one of:

the support leg tubes are mounted on a front side of the seat body, the backrest tubes are mounted on a rear side of the seat body, and the support recliner cushion is mounted between the support leg tubes and the backrest tubes along a front-back direction;

the support leg tubes are mounted on a left side of the seat body, the backrest tubes are mounted on a right side of the seat body, and the support recliner cushion is mounted between the support leg tubes and the backrest tubes along a left-right direction; or the support legs comprise front support leg tubes and rear support leg tubes mounted on front sides and rear sides of the support bodies, respectively.

14. The rocking chair according to claim 8, wherein the seat body comprises two sub-seat bodies assembled in a mirror symmetrical manner, two bearings sleeved outside the central connecting shaft, and a limit sleeve; the limit sleeve is located between the two bearings; limit steps are formed at outer ends of the two sub-seat bodies that correspond to the central channel; and the two bearings are pressed into the central channel between the limit sleeve and the limit steps.

15. The rocking chair according to claim 14, wherein the rocking frame assembly comprises support leg tubes, backrest tubes, and a support recliner cushion; and at least one of:

the support leg tubes are mounted on a front side of the seat body, the backrest tubes are mounted on a rear side of the seat body, and the support recliner cushion is mounted between the support leg tubes and the backrest tubes along a front-back direction;

the support leg tubes are mounted on a left side of the seat body, the backrest tubes are mounted on a right side of the seat body, and the support recliner cushion is mounted between the support leg tubes and the backrest tubes along a left-right direction; or the support legs comprise front support leg tubes and rear support leg tubes mounted on front sides and rear sides of the support bodies, respectively.

16. The rocking chair according to claim 14, further comprising fixed connecting shafts, wherein blind holes are provided in opposite end surfaces of the two sub-seat bodies; and two ends of each of the fixed connecting shafts are fixedly inserted into the blind holes of the two sub-seat bodies so that the two sub-seat bodies are fixedly assembled to form the seat body.

17. The rocking chair according to claim 16, wherein the rocking frame assembly comprises support leg tubes, backrest tubes, and a support recliner cushion; and at least one of:

the support leg tubes are mounted on a front side of the seat body, the backrest tubes are mounted on a rear side of the seat body, and the support recliner cushion is mounted between the support leg tubes and the backrest tubes along a front-back direction;

the support leg tubes are mounted on a left side of the seat body, the backrest tubes are mounted on a right side of the seat body, and the support recliner cushion is mounted between the support leg tubes and the backrest tubes along a left-right direction; or the support legs comprise front support leg tubes and rear support leg tubes mounted on front sides and rear sides of the support bodies, respectively.

18. The rocking chair according to claim 1, wherein the rocking frame assembly comprises support leg tubes, backrest tubes, and a support recliner cushion; and at least one of:

the support leg tubes are mounted on a front side of the seat body, the backrest tubes are mounted on a rear side of the seat body, and the support recliner cushion is mounted between the support leg tubes and the backrest tubes along a front-back direction;

the support leg tubes are mounted on a left side of the seat body, the backrest tubes are mounted on a right side of the seat body, and the support recliner cushion is mounted between the support leg tubes and the backrest tubes along a left-right direction; or the support legs comprise front support leg tubes and rear support leg tubes mounted on front sides and rear sides of the support bodies, respectively.

* * * * *